US011744757B2

(12) United States Patent
Frye

(10) Patent No.: US 11,744,757 B2
(45) Date of Patent: Sep. 5, 2023

(54) LEG POSITIONER FOR DIRECT ANTERIOR APPROACH TOTAL HIP ARTHROPLASTY

(71) Applicant: West Virginia University, Morgantown, WV (US)

(72) Inventor: Benjamin Frye, Morgantown, WV (US)

(73) Assignee: West Virginia University, Morgantown, WV (US)

( * ) Notice: Subject to any disclaimer, the term of this patent is extended or adjusted under 35 U.S.C. 154(b) by 592 days.

(21) Appl. No.: 16/523,304

(22) Filed: Jul. 26, 2019

(65) Prior Publication Data

US 2020/0038276 A1 Feb. 6, 2020

Related U.S. Application Data

(60) Provisional application No. 62/712,640, filed on Jul. 31, 2018.

(51) Int. Cl.
*A61G 13/12* (2006.01)
*A61G 13/00* (2006.01)

(52) U.S. Cl.
CPC ..... *A61G 13/1285* (2013.01); *A61G 13/0081* (2016.11); *A61G 13/1245* (2013.01)

(58) Field of Classification Search
CPC .. A61G 13/1235; A61G 13/124; A61G 7/075; A61G 13/122; A61G 13/1255; A61G 1/044; A61G 13/129; A61G 2210/10; A61G 2210/50; A61F 5/3761
See application file for complete search history.

(56) References Cited

U.S. PATENT DOCUMENTS 4,730,609 A * 3/1988 McConnell ..... A61B 46/00 128/853
5,063,918 A * 11/1991 Guhl ..... A61F 5/04 606/53
5,281,001 A * 1/1994 Bergsten ..... A47C 1/03 297/411.24
5,390,383 A * 2/1995 Carn ..... A61G 13/12 128/877

* cited by examiner

*Primary Examiner* — Ophelia A Hawthorne
(74) *Attorney, Agent, or Firm* — Thomas | Horstemeyer, LLP

(57) ABSTRACT

Disclosed is a leg positioner apparatus to secure placement of a leg in total hip arthroplasty procedures. The leg positioner apparatus can attach to a standard operating table and helps in positioning the operative leg for femoral preparation. The leg positioner apparatus includes a post assembly mounted to an attachment bracket. The attachment bracket can be attached to the operating table. The operative leg can rest on the post assembly during the surgical procedure.

13 Claims, 6 Drawing Sheets

LEG POSITIONER FOR DIRECT ANTERIOR APPROACH TOTAL HIP ARTHROPLASTY

CROSS REFERENCE TO RELATED APPLICATION

This application claims priority to U.S. Provisional Application Ser. No. 62/712,640 filed Jul. 31, 2018, which is hereby incorporated by reference in its entirety.

BACKGROUND

Geriatrics are highly prone to hip abnormalities and nearly a million hip surgeries are performed each year, as per the National Institute of Health (NIH). The United Nations has estimated that the number of people aged over 60 years would swell up to 2.1 billion by 2050, more than doubling from 962 million as of 2017. About 600,000 hip implant procedures are conducted each year worldwide among individuals aged between 40 and 50 years. Patient positioners play an important role in healthcare from the prevention of pressure ulcers to assisting with surgeries and recovery. They facilitate surgery and prevent injury by ensuring patients do not move during procedures. The stability of the patient is critical during hip surgery and the positioners help prevent the patient movement making it easier for the surgeon.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
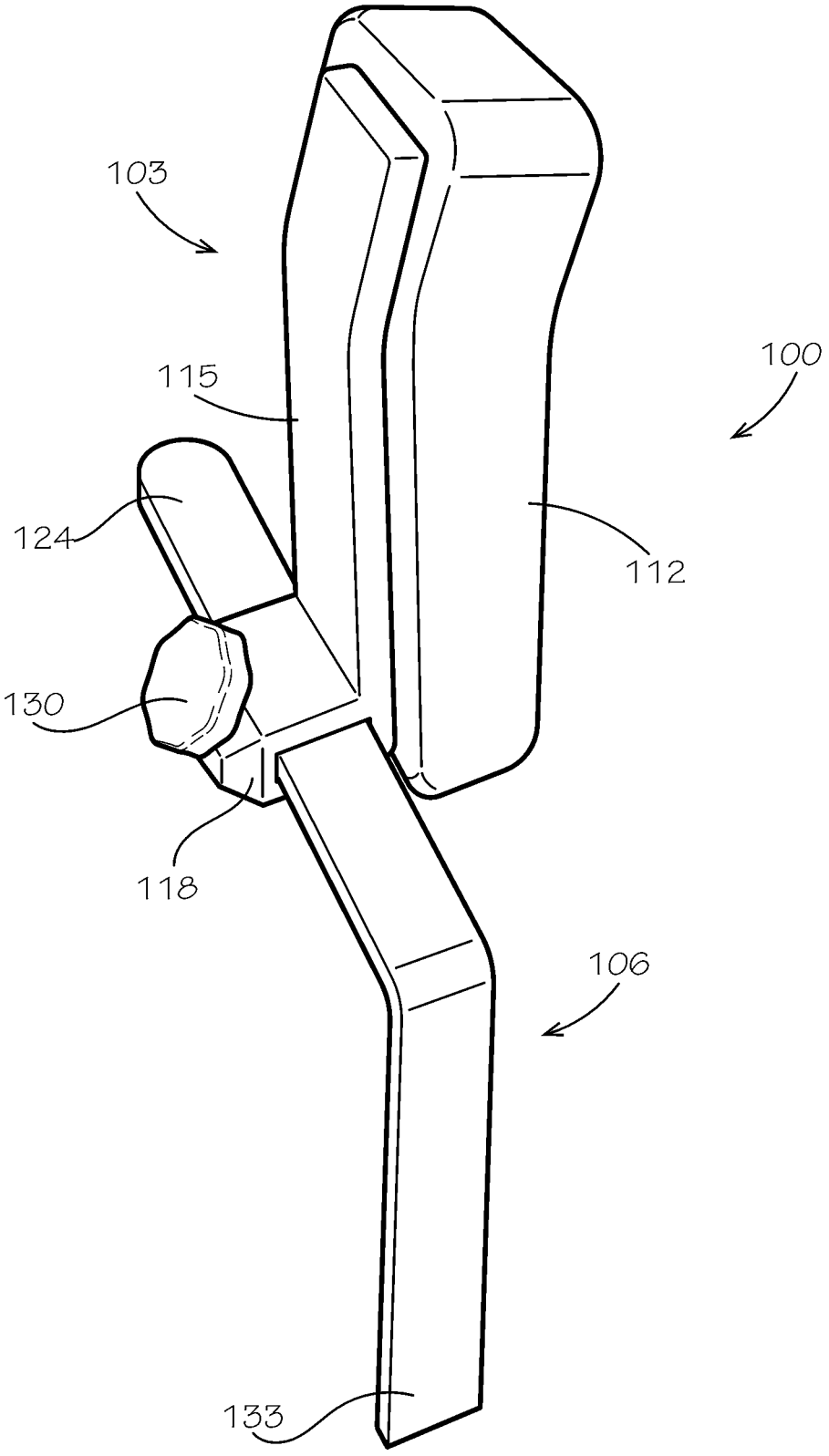
FIG. 1 is an example of a perspective view of a leg positioner apparatus according to various embodiments of the present disclosure.

Disclosed herein are various embodiments related to a leg positioner apparatus with applications in total hip arthroplasty procedures. The leg positioner is configured to attach to a standard operating table and helps in positioning the operative leg for femoral preparation. The leg positioner makes the surgery easier, more efficient, and helps to maintain sterility while allowing one assistant to position the leg for femoral preparation.

The direct anterior approach for total hip arthroplasty is a procedure that promotes accurate surgery with fast patient recovery. The direct anterior approach for total hip arthroplasty is an increasingly popular surgical technique. The accuracy and fast patient recovery continues to attract more surgeons. Many surgeons wish to perform this surgery on a standard table due to its familiarity, availability, and to accurately access hip stability and leg length equality. Positioning the operative leg for femoral preparation can be challenging, especially when performed on a standard operating table. This procedure often requires the use of an extra assistant or methods that jeopardize sterility of the procedure.

Known techniques for positioning an operative leg during surgery require an additional assistant to hold the operative leg. Additional surgical assistants are usually not available and can be an expensive addition to the process. Another known technique includes having a surgical assistant hold the operative between their legs, which can jeopardize sterility of the procedure. Losing sterility can increase the risk of wound complications and surgical site infection.

Known leg positioners for direct anterior approach total hip arthroplasty comprise components of traction tables that secure the operative leg in a traction boot. This requires the purchase of new beds. Further, the use of the known leg positioners limits the assessment of hip stability and leg length discrepancy due to the leg being secured in a boot. There are no known leg positioners that can be attached to a standard operating table. The leg positioner of the present disclosure allows surgeons the ability to operate on a standard table. Without the use of the leg positioner of the present disclosure, the surgery can be performed on commercially available traction tables which carry a high capital cost and require larger operating rooms for hospitals. Further, the traction tables limit the assessment of leg length and hip stability for the surgeon.

A unique advantage of the leg positioner of the present disclosure over known techniques and devices is that the disclosed leg positioner makes surgery easier and efficient for the surgeons by maintaining the sterility of the hip arthroplasty procedure and also allowing the surgery to be performed on a standard operating table. Sterility is very important for minimizing the risk of wound complications and surgical site infection. The surgeons are also able to accurately test the hip stability and evaluate for leg length discrepancy on a standard operating table. This also results in cost savings due to elimination of the need for an extra surgical assistant. There is no similar device available commercially and the traction tables/boots available require purchase of new beds since they cannot be attached to the standard operating table. Further due to limited movement of leg in a boot prevents an accurate diagnosis of the situation by the surgeon.

Turning now to FIG. 1, shown is a perspective view of an example leg positioner apparatus 100 according to various embodiments of the present disclosure. The leg positioner apparatus 100 comprises a post assembly 103 mounted to an attachment bracket 106. The post assembly 103 is designed to support a shin of a leg to avoid movement during surgery. The attachment bracket 106 is designed to mount to an operating table such that a leg of a patient can be supported by the post assembly 103.

In some examples, the post assembly 103 can comprise a post bracket 109 and a leg resistance surface designed to support and minimize movement of a limb during surgery. In some embodiments, leg resistance surface comprises a post bracket 109. In other examples, the leg resistance surface comprises a padding 112 that is affixed to a first post bracket member 115 of the post bracket 109. In FIG. 1, the padding 112 is affixed to a distal face of a first post bracket member 115 of the post bracket 109. In other embodiments, the padding 112 can substantially surround all of or a portion of the post bracket member 115. The padding can be affixed to the post bracket 109 via an adhesive, a fastener, a connector, or other type of fastening means as can be appreciated. The padding 112 can comprise a firm foam padding, such as, for example, a polyurethane foam, or other type of padding that can support the shin of a leg to avoid movement during surgery. The padding material can comprise polyurethane, polyester, polystyrene, polyethylene, vinyl, silicone, rubber, and/or other type of padding material as can be appreciated.

The post bracket 109 can comprise an angled bracket (e.g., I-shaped bracket, corner bracket, etc.) having the first post bracket member 115 positioned at an angle relative to the second post bracket member 118. For example, the first post bracket member 115 can be positioned at a substantially right angle relative to the second post bracket member 118 such that the first post bracket member 115 extends away from and is substantially perpendicular to the second post bracket member 118. Although the first post bracket member 115 is discussed and illustrated in FIG. 1 as extending at a substantially right angle relative to the second post bracket member 118, the angle is not limited to a right angle and can be greater than or less than a right angle in some embodiments. The first post bracket member 115 can include a plate, a rod, or other suitable non-flexible component as can be appreciated.

The second post bracket member 118 comprises a receiving slot 121 extending along a horizontal axis of the second post bracket member 118 and between a first side of the second post bracket member 118 and a second side of the second post bracket member 118. The receiving slot 121 is sized and shaped for receiving an end of the first attachment bracket member 124 of the attachment bracket 106.

According to various embodiments, the receiving slot 121 is sized to allow the first attachment bracket member 124 to engage with and extend through the receiving slot 121 such that the post assembly 103 can slide along a first axis relative to a length of the first attachment bracket member 124 as the first attachment bracket member 124 engages with and extends through the receiving slot 121 of the second post bracket member 118. Being able to adjust the position of the post assembly 103 along the axis relative to the length of the first attachment bracket member 124 provides adaptability for different types of patients, leg sizes, leg lengths, etc.

According to various embodiments, the first attachment bracket member 124 can engage with and enter the receiving slot 121 at either the first side of the second post bracket member 118 or the second side of the second post bracket member 118 to account for different arrangements of the leg positioner apparatus 100 required to accommodate a left leg arrangement versus a right leg arrangement.

According to various embodiments, the second post bracket member 118 comprises an aperture 127 (FIG. 3) for receiving a fastener 130 or other type of connecting component that can be used to engage with and fix the position and movement of the first attachment bracket member 124 relative to the second post bracket member 118 to allow the post assembly 103 to be mounted to the attachment bracket 106. The fastener 130 can comprise a screw, screw knob, pin, nail, and/or other type of fastener as can be appreciated.

In some examples, the post assembly 103 is mounted to the attachment bracket 106 in a permanent fixed position. For example, the post assembly 103 can be mounted to the attachment bracket 106 via a solder, and/or other type of means to permanently mount the post assembly 103 to the angled attachment bracket 106. In another example, the post assembly 103 can be mounted to the attachment bracket 106 via an adhesive, or other type of fastening means as can be appreciated.

The attachment bracket 106 can include a bracket that that can be mounted to an operating table. The attachment bracket 106 can include an angled bracket, corner bracket, c-clamp bracket, or other type of bracket as can be appreciated. The attachment bracket 106 can include a first attachment bracket member 124 and a second attachment bracket member 133. The first attachment bracket member 124 can be positioned at an angle relative to a second attachment bracket member 133. According to various embodiments, the post assembly 103 can be coupled to the attachment bracket 106 such that the first post bracket member 115 extends away from the first attachment bracket member 124 in a first direction and the second attachment bracket member 133 extends away from the first attachment bracket member 124 in a second direction that directly or indirectly opposes the first direction.

Figure 4:
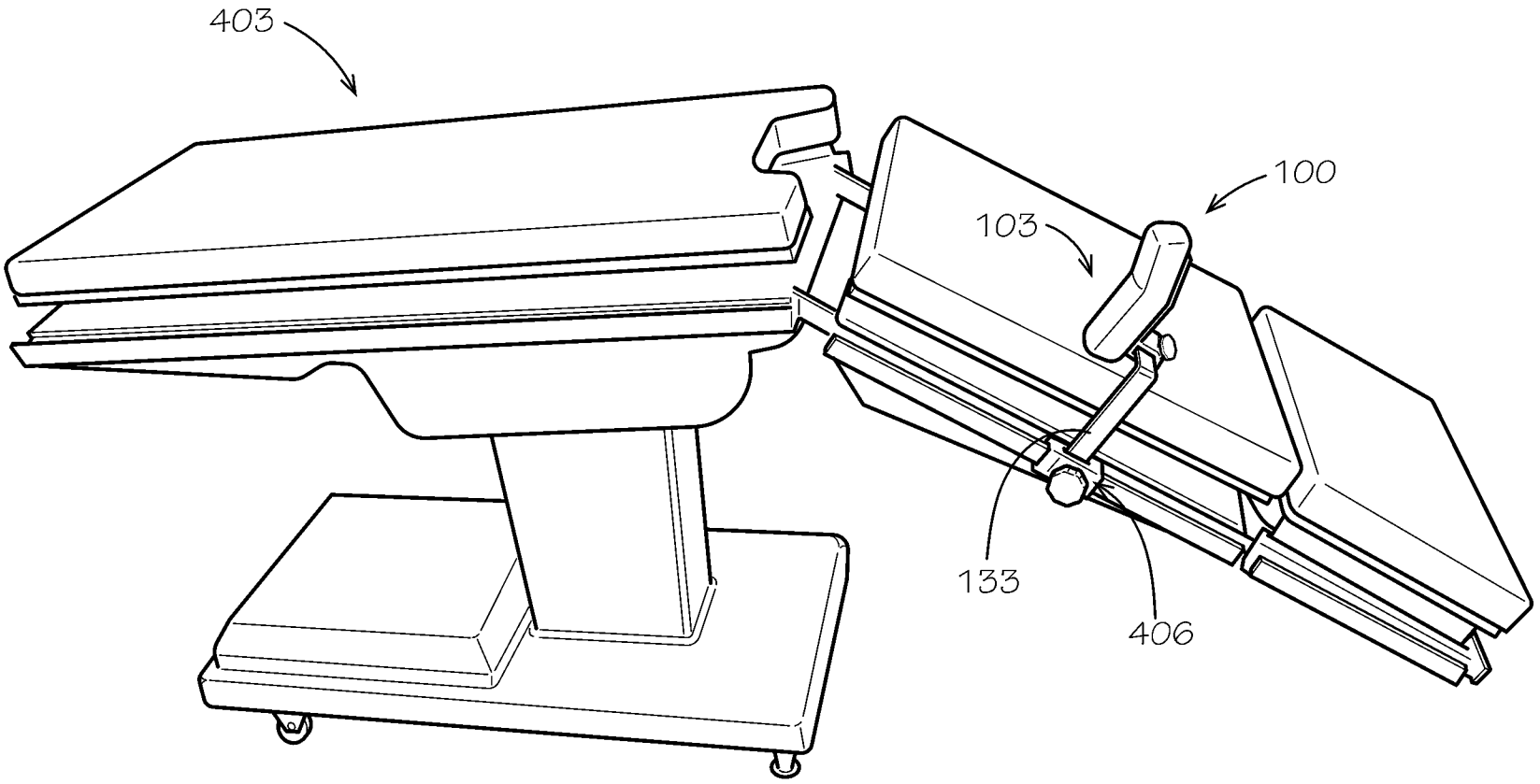
FIG. 4 is an example of a perspective view of the leg positioner apparatus of FIG. 1 coupled to a standard operating table according to various embodiments of the present disclosure.

According to various embodiments of the present disclosure, the second attachment bracket member 133 can be sized and shaped to allow attachment to a standard operating table. As shown in FIG. 4, the second attachment bracket member 133 can engage with and be received in a mounting apparatus 406 that is mounted to a side rail of the operating table 403. For example, the mounting apparatus 406 can comprise a slot that is designed to receive an end of the second attachment bracket member 133 for securing the leg positioner apparatus 100 onto the operating table 403. In some embodiments, the mounting apparatus 406 can comprise a fastener configured to secure the position of the second attachment bracket member 133 relative to the mounting apparatus 406. In some examples, the second attachment bracket member 113 is slidably coupled to the mounting apparatus 406 to provide adjustment of the leg positioner apparatus 100 along a second axis relative to a length of the second attachment bracket member 133.

The attachment bracket 106 and the post bracket 109 can metal, plastic, or other type of material as can be appreciated. In addition, the components of the leg positioner apparatus 100 (e.g., the attachment bracket 106, the post bracket 109, padding 112, etc.) are not limited to the shapes, sizes, and dimensions shown in the drawings and can comprise any shape, size, and/or dimension as can be appreciated to allow a leg to be positioned and secured during a surgical procedure.

Figure 2:
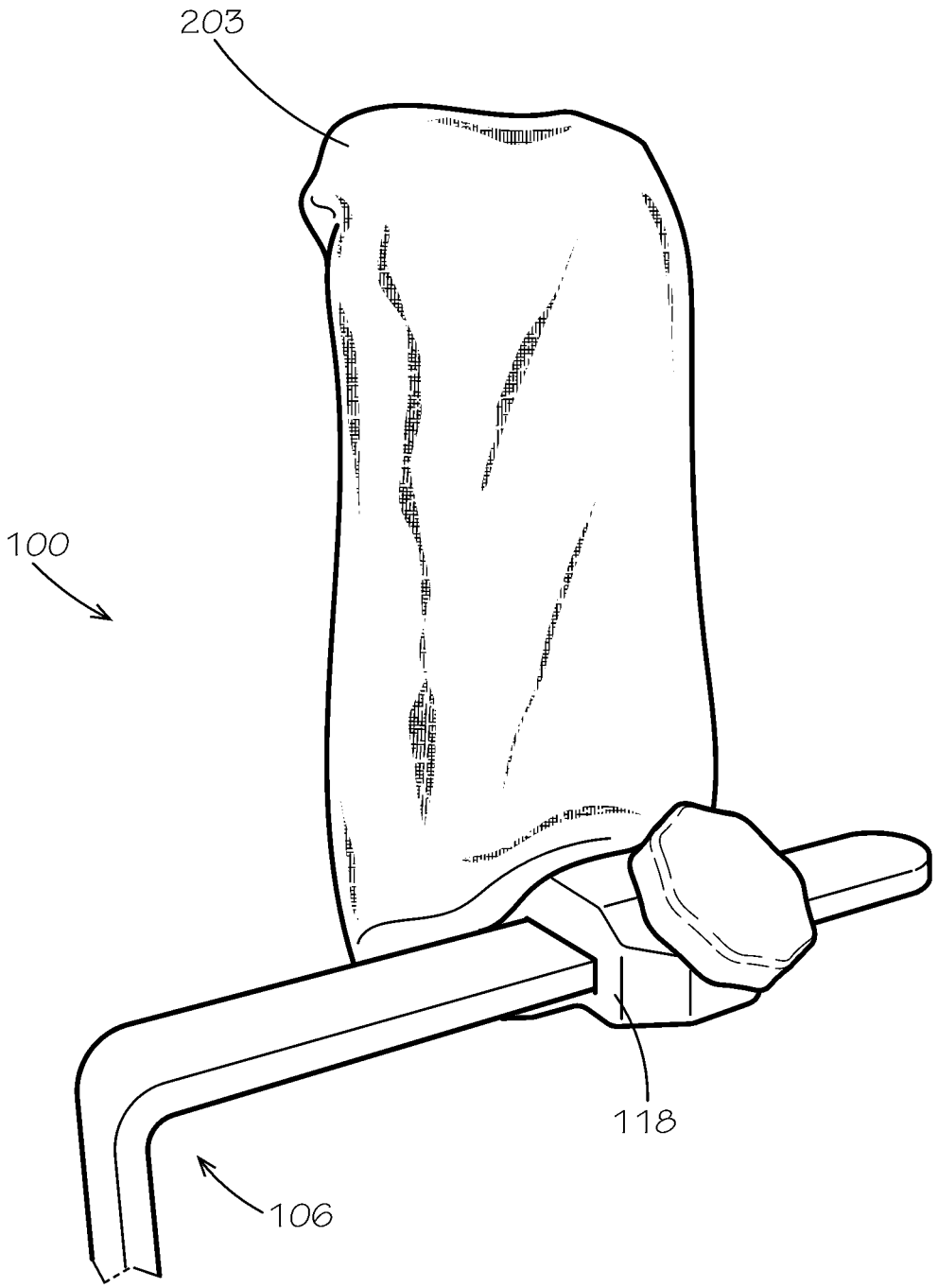
FIG. 2 is an example of a perspective view of the leg positioner apparatus of FIG. 1 having a sleeve over the post assembly of the leg positioner apparatus according to various embodiments of the present disclosure.

Moving on to FIG. 2, shown is a perspective view of the leg positioner apparatus 100 having a sleeve 203 placed over the first post bracket member 115 and padding 112 of the post assembly 103. The sleeve 203 can be designed to cover a portion of the post assembly 103, including the first post bracket member 115 and/or the padding 112 during use of the leg positioner apparatus 100 during a surgical procedure. In particular, the sleeve 203 can be disposable or reusable and can comprise a fabric, a plastic, and/or other type of material as can be appreciated. The sleeve 203 can further comprise a sterile material designed to prevent and/or minimize contamination of the leg positioner apparatus 100 during a surgical procedure.

Figure 3:
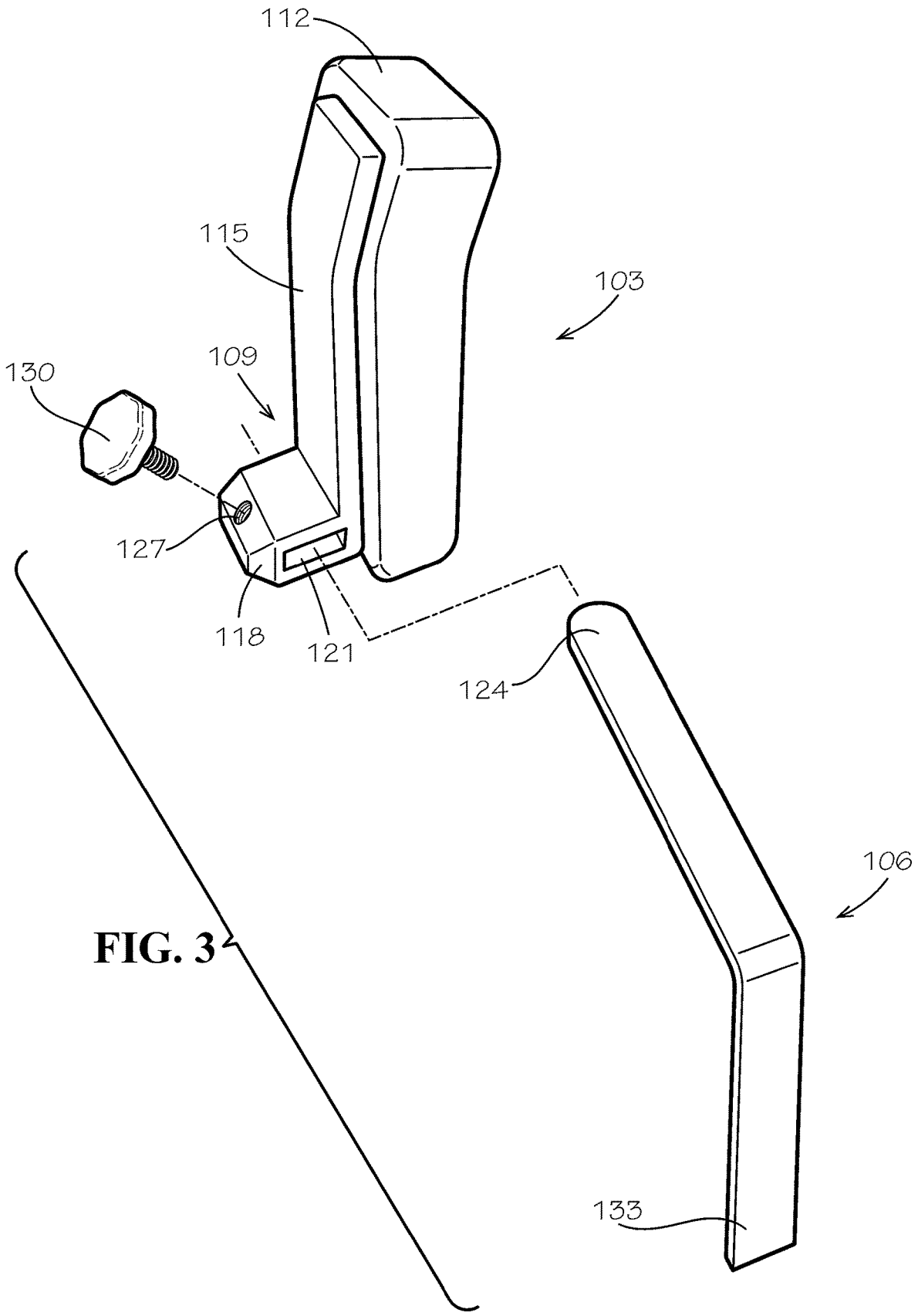
FIG. 3 is an example of an expanded view of the leg positioner apparatus of FIG. 1 according to various embodiments of the present disclosure.

Turning now to FIG. 3, shown is an expanded view of an example leg positioner apparatus 100 according to various embodiments of the present disclosure. In particular, FIG. 3 illustrates the post assembly 103 separated from the attachment bracket 106 according to various embodiments. The second post bracket member 118 of the post bracket 109 of the post assembly 103 includes a receiving slot 121 for receiving an end of the first attachment bracket member 124 of the attachment bracket 106. As the receiving slot 121 extends from a first side of the second post bracket member 118 to a second side of the second post bracket member 118, the first attachment bracket member 124 can be placed into either opening of the receiving slot 121 as need to account for which side of the operating table the leg positioner apparatus 100 is to be placed.

The first attachment bracket member 124 can engage with and extend through the receiving slot 121 such that the post assembly 103 is slidably coupled to the attachment bracket 106 to provide adjustment of a position of the post assembly 103 along an axis relative to the length of the first attachment bracket member 124. When the suitable position of the post assembly 103 along the length of the first attachment bracket member 124 is determined, the fastener 130 can engage with and through the aperture 127 and abut with the first attachment bracket member 124 to fix the position of post assembly 103 to the first attachment bracket member 124.

Referring next to FIG. 4, shown is an example of the leg positioner apparatus 100 mounted to a standard operating table 403 according to various embodiments of the present disclosure. As shown in FIG. 4, the leg positioner apparatus 100 is attached to the standard operating table 403. In particular, the second attachment bracket member 133 of the attachment bracket 106 is engaged with and coupled to a mounting apparatus 406 coupled to a side rail of the operating table 403. According to various embodiments, the second attachment bracket member 133 can be slidably coupled to the mounting apparatus 406 to provide adjustment of the apparatus along an axis relative to a length of the second attachment bracket member 133. As shown in FIG. 4, the leg positioner apparatus 100 is mounted to the operating table such that the portion of the post assembly 103 including the first post bracket member 115 of the post bracket 109 extends perpendicular to an in an upward direction relative to a top surface of the operating table 403.

Figure 5:
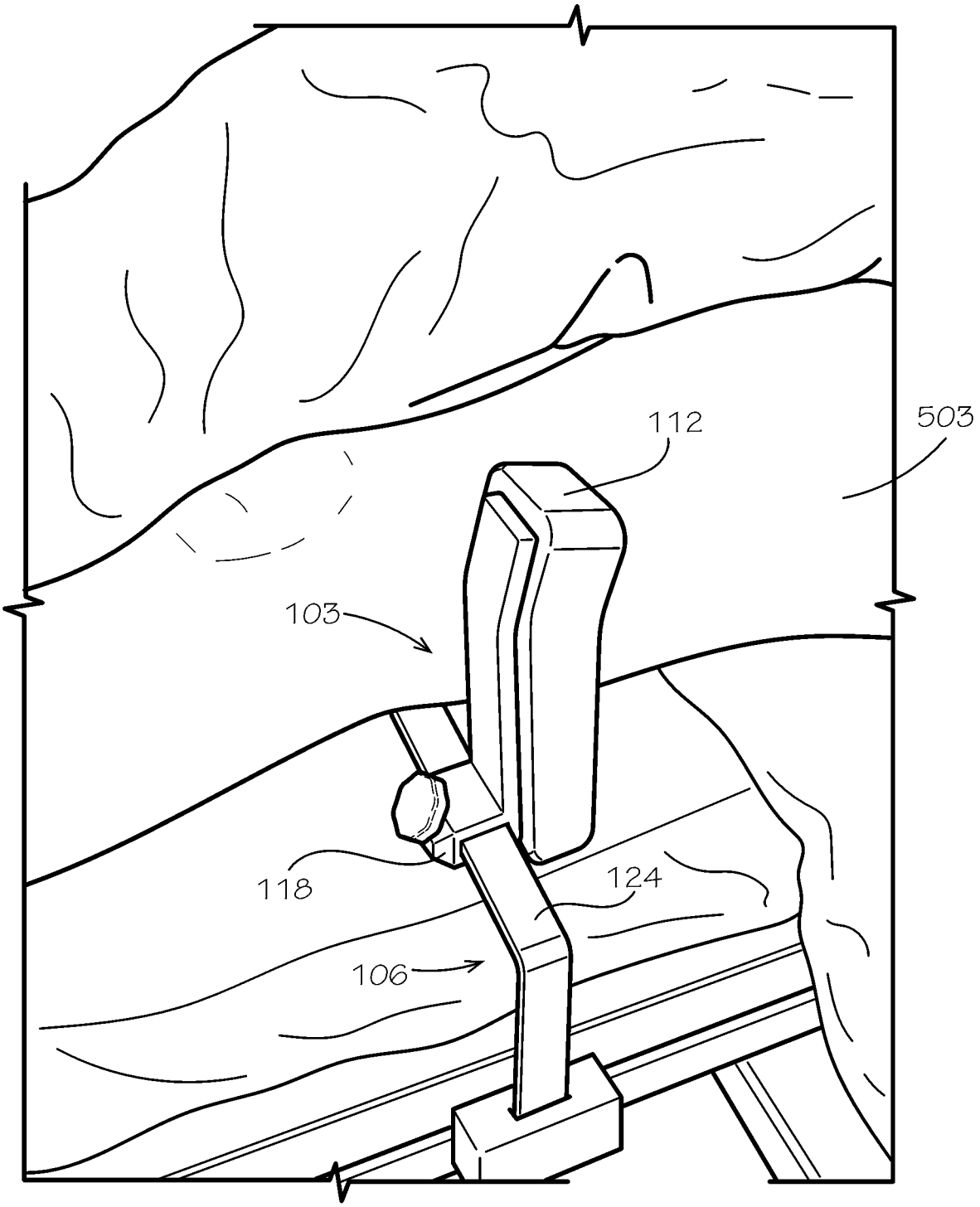
FIGS. 5 and 6 are examples of the leg positioner apparatus of FIG. 1 in use during a surgical procedure according to various embodiments of the present disclosure.
Figure 6:
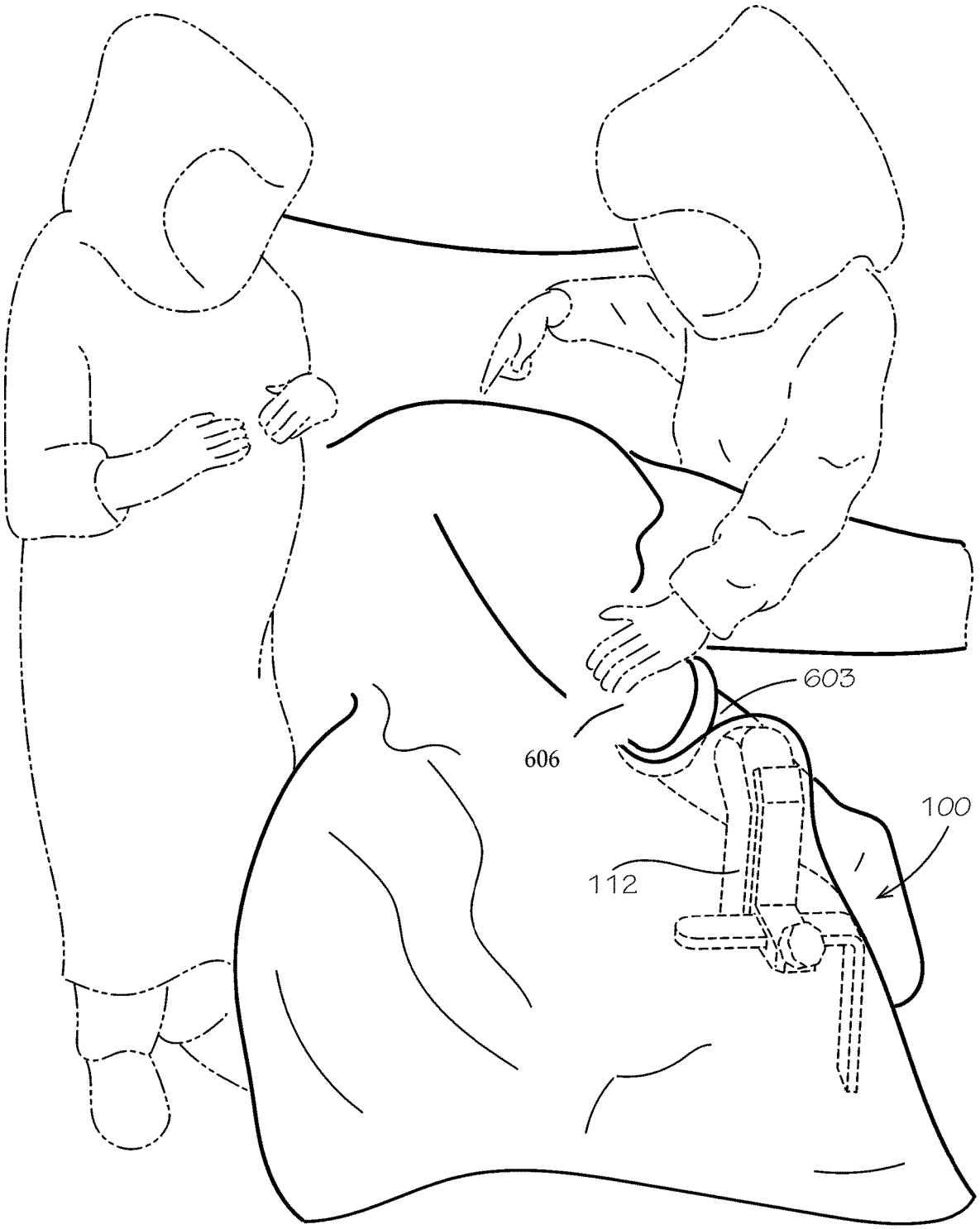

Moving on to FIGS. 5 and 6 shown are examples of the leg positioner apparatus 100 in use during a surgical procedure. In particular, FIG. 5 illustrates the non-operative leg 503 positioned next to the leg positioner apparatus 100 mounted on an operating table 403 according to various embodiments of the present disclosure. During the surgical procedure, the operative leg 606 will be positioned in a figure four configuration relative to the non-operative leg 503 such that the shin 603 (FIG. 6) of the operative leg rests on the post assembly 103. In FIG. 5, the non-operative leg 503 is not being supported by the leg positioner apparatus 100 but is rather positioned next to the leg positioner apparatus 100. FIG. 6 illustrates the leg positioner apparatus 100 in use during the surgical procedure. In particular, FIG. 6 illustrates the operative leg 606 positioned in a figure four configuration such that the shin 603 of the operative leg 606 rests on the padding 112 or other leg resistance surface of the post assembly 103 of the leg positioner apparatus 100.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. An apparatus for positioning a leg during a surgical procedure, comprising:

an attachment bracket configured to detachably attach to a standard operating table, the attachment bracket comprising a first attachment member and a second attachment member; and a post assembly comprising a first post bracket member and a second post bracket member, the second post bracket member being slidably coupled to the first attachment member of the attachment bracket to provide adjustment of the post assembly along a first axis, a horizontal axis of the second post bracket member being oriented in a same direction as the first axis, and the post assembly being configured to support the leg of a patient during the surgical procedure, wherein the post assembly comprises a padding affixed to a distal end of the first post bracket member.

2. The apparatus of claim 1, further comprising a sleeve disposed about a portion of the post assembly.

3. The apparatus of claim 2, wherein the sleeve is disposable.

4. The apparatus of claim 1, wherein the first post bracket member is positioned at an angle relative to the second post bracket member.

5. The apparatus of claim 1, wherein the second post bracket member of the post assembly comprises a receiving slot, and the first attachment member of the attachment bracket extends through the receiving slot along the first axis, the first attachment member being substantially parallel to the second post bracket member.

6. The apparatus of claim 1, where the post assembly is slidably coupled to the attachment bracket such that the post assembly is moveable along a length of an attachment bracket member of the attachment bracket.

7. A leg positioner apparatus, comprising:

an attachment bracket;

a post assembly being slidably coupled to the attachment bracket to provide adjustment of the post assembly along a first axis, the post assembly comprising:

a post bracket comprising a first post bracket member and a second post bracket member; and a leg resistance surface provided on a distal face of the first post bracket member, a horizontal axis of the second post bracket member being oriented in a same direction as the first axis, wherein the attachment bracket comprises a pair of members, the post assembly being slidably coupled to a first member of the attachment bracket, wherein the leg resistance surface comprises a pad affixed to the distal surface of the first post bracket member.

8. The leg positioner apparatus of claim 7, wherein a second member of the pair of members is configured to be slidably coupled to a mounting apparatus on an operating table to provide adjustment of the leg positioner apparatus along a second axis.

9. The leg positioner apparatus of claim 7, wherein the second post bracket member comprises a receiving slot, and an attachment bracket member of the attachment bracket extends through the receiving slot of the second post bracket member such that the attachment bracket member is substantially perpendicular to the first post bracket member.

10. The leg positioner apparatus of claim 7, further comprising a fastener component for fixing a position of the post assembly along the attachment bracket.

11. The leg positioner apparatus of claim 7, further comprising a sleeve disposed along a portion of the post assembly.

12. A system for securing placement of a leg of a patient during a surgical procedure, the system comprising:

an operating table;

an attachment bracket configured to detachably attach to the operating table, the attachment bracket comprising a first attachment member and a second attachment member; and a leg positioner apparatus coupled to the operating table, the leg positioner apparatus comprising:

a post assembly comprising a first post bracket member and a second post bracket member, the second post bracket member being slidably coupled to the first attachment member along a first axis, the second attachment member being mounted to the operating table, and the post assembly comprising a leg resistance surface affixed to a distal face of the second post bracket member that extends upwardly relative to a top surface of the operating table, a horizontal axis of the distal face of the the second post bracket member being oriented in a same direction as the first axis, wherein the leg resistance surface comprises a pad affixed to the distal surface of the first post bracket member.

13. The system of claim 12, wherein the leg positioner apparatus is designed such that the leg resistance surface of the post assembly engages with the shin of the leg of the patient when the leg is positioned in a figure four configuration.

* * * * *